US008853573B2

(12) United States Patent
Dahl et al.

(10) Patent No.: US 8,853,573 B2
(45) Date of Patent: Oct. 7, 2014

(54) METHOD FOR LOCKING A COVER OF AN ELECTRICAL SWITCH

(75) Inventors: Jörg-Uwe Dahl, Werder (DE); Katja Manthey, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 117 days.

(21) Appl. No.: 13/599,556

(22) Filed: Aug. 30, 2012

(65) Prior Publication Data

US 2013/0056338 A1 Mar. 7, 2013

(30) Foreign Application Priority Data

Sep. 2, 2011 (DE) ..... 10 2011 082 074

(51) Int. Cl.

| | |
|---|---|
| ***H01H 1/64*** | (2006.01) |
| ***H01H 9/22*** | (2006.01) |
| ***H01H 71/52*** | (2006.01) |
| ***H01H 9/02*** | (2006.01) |
| ***H01H 71/02*** | (2006.01) |

(52) U.S. Cl.

CPC . *H01H 9/02* (2013.01); *H01H 9/22* (2013.01); *H01H 71/521* (2013.01); *H01H 71/0228* (2013.01)

USPC ..... 200/293; 200/43.01

(58) Field of Classification Search

CPC ... H01H 71/0228; H01H 71/521; H01H 9/22; H01H 9/02; H01H 71/08; H01H 13/04; H01H 1/58

USPC ..... 200/293, 43.01, 43.02, 43.04, 43.11, 200/43.12, 43.22, 50.12

See application file for complete search history.

(56) References Cited

U.S. PATENT DOCUMENTS

| | | | | |
|---|---|---|---|---|
| 3,018,341 | A | 1/1962 | Bassani | |
| 4,757,294 | A * | 7/1988 | Todaro et al. | 335/202 |
| 4,978,816 | A * | 12/1990 | Castonguay et al. | 200/43.14 |
| 7,420,133 | B2 * | 9/2008 | Farrow et al. | 200/50.15 |

FOREIGN PATENT DOCUMENTS

| | | | |
|---|---|---|---|
| DE | 3642719 | A1 | 6/1988 |
| DE | 4235443 | A1 | 4/1994 |
| DE | 20204004 | U1 | 7/2002 |

OTHER PUBLICATIONS

German Priority Document No. 10 2011 082 074.4, filed Sep. 2, 2011.

English-Language Abstract for French Patent No. 2837319, which corresponds to DE-20204004-U1.

* cited by examiner

*Primary Examiner* — Edwin A. Leon

(74) *Attorney, Agent, or Firm* — Harness, Dickey & Pierce, P.L.C.

(57) ABSTRACT

A device is disclosed including a removable cover of a housing of an electrical switch and a handle. In at least one embodiment, the handle, by way of its position, switches the electrical switch between different states. Further, the handle is connected to the housing and the handle includes a contour which is embodied, at least in one position of the handle, to interact with the cover for locking the removable cover.

15 Claims, 4 Drawing Sheets

METHOD FOR LOCKING A COVER OF AN ELECTRICAL SWITCH

PRIORITY STATEMENT

The present application hereby claims priority under 35 U.S.C. §119 to German patent application number DE 10 2011 082 074.4 filed Sep. 2, 2011, the entire contents of which are hereby incorporated herein by reference.

FIELD

The invention generally relates to a method for locking a cover of an electrical switch.

BACKGROUND

Electrical switches are used for switching electrical currents. One class of electrical switches is what are referred to as power circuit breakers, which can typically switch currents of 100 A and more. The power circuit breakers are typically accommodated in a housing.

The individual phases of the currents can be switched in what are referred to as pole cassettes. A pole cassette comprises a housing in which a movable and a fixed contact are accommodated, which can be mechanically separated or brought together for switching off for switching on the currents.

During separation under a current flow by movable and fixed contact of a pole cassette an arc is produced which is extinguished in an extinction chamber. The arc ionizes the gas of the extinction chamber and generates excess pressure in the extinction chamber which is equivalent to the arc energy. Power circuit breakers are also known which do not contain any pole cassettes but in which movable and fixed contact are shielded in some other way in their housing.

The housing of the electrical switch is typically constructed such that it can be closed off with a removable cover, the so-called accessory cover. Typically accessories are built into the housing of the electrical switch in the vicinity of a handle. The handle serves to manually switch the electrical switches between different states, for example switching them on or switching them off. In order to install or exchange the accessories the housing is provided with a removable accessory cover which can be easily opened or closed again by an installer. In the event of the short circuit switching off of the electrical switch the ionization of the gases of the extinction chamber by the arc cause high-pressures to be produced in the electrical switch. These high pressures can lead to the accessory cover being subjected to mechanical stresses or can even destroy the cover.

SUMMARY

A device is provided in at least one embodiment which makes it possible to close off the accessory space in the housing of an electrical switch reliably with a removable accessory cover.

In at least one embodiment the device comprises a removable cover of the housing of the electrical switch and a handle, with the handle switching the electrical switch between different states through its position and with the handle comprising a contour which is embodied, at least in one position of the handle, to interact with the cover and to lock the cover.

BRIEF DESCRIPTION OF THE DRAWINGS

The invention is explained below with reference to the following figures, in which.

Figure 1:
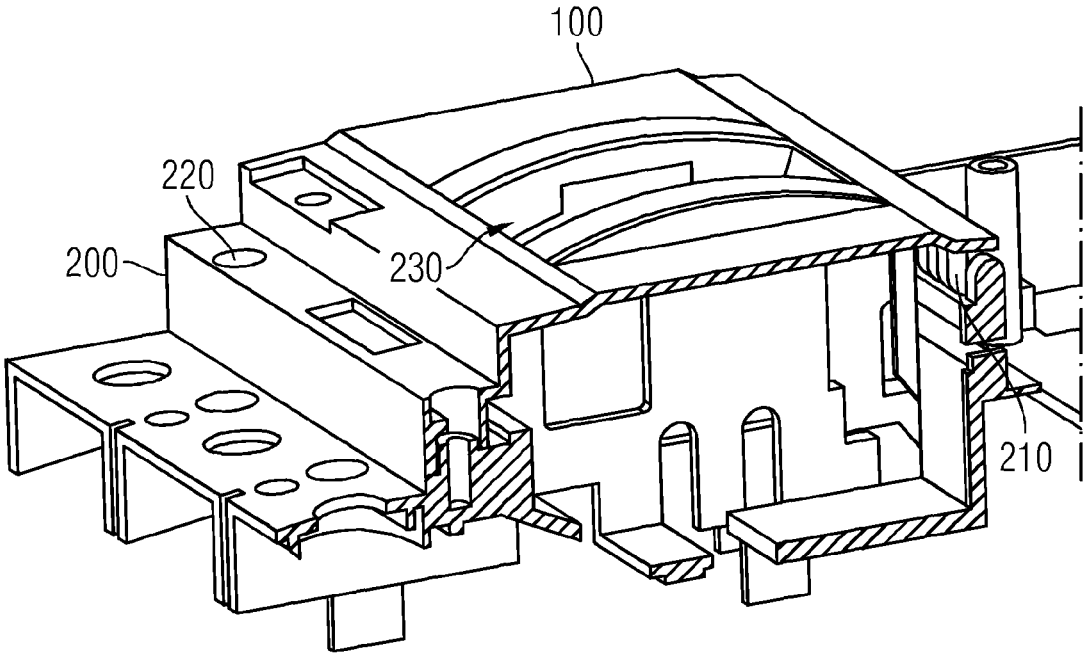
FIG. 1 shows a housing of an electrical switch with a removable cover.

It should be noted that these Figures are intended to illustrate the general characteristics of methods, structure and/or materials utilized in certain example embodiments and to supplement the written description provided below. These drawings are not, however, to scale and may not precisely reflect the precise structural or performance characteristics of any given embodiment, and should not be interpreted as defining or limiting the range of values or properties encompassed by example embodiments. The use of similar or identical reference numbers in the various drawings is intended to indicate the presence of a similar or identical element or feature.

DETAILED DESCRIPTION OF THE EXAMPLE EMBODIMENTS

The present invention will be further described in detail in conjunction with the accompanying drawings and embodiments. It should be understood that the particular embodiments described herein are only used to illustrate the present invention but not to limit the present invention.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

In at least one embodiment the device comprises a removable cover of the housing of the electrical switch and a handle, with the handle switching the electrical switch between different states through its position and with the handle comprising a contour which is embodied, at least in one position of the handle, to interact with the cover and to lock the cover.

It is advantageous in this at least one embodiment the locking of the removable cover additionally stabilizes said cover and through this increases the ability of the cover to withstand mechanical stress in the event of a short circuit switch-off of the electrical switch. In addition the device has the effect of locking the removable cover at least in one position of the handle and in this position the cover cannot be accidentally released from the housing.

In an embodiment of the invention, the cover is an accessory cover for covering built-in accessories in the housing of the electrical switch.

In a further embodiment of the invention, the contour of the handle is embodied in the form of a hook. The contour of the handle can be embodied so that it interacts with a projection of the cover.

In a further embodiment of the invention, at least the states of switching-on and switching-off the electrical switch are comprised by the position of the handle.

The contour of the handle can interact with the cover if the electrical switch is switched on by the position of the handle.

In a further embodiment of the invention, the contour of the handle is embodied so that in precisely one position of the handle the contour of the handle interacts with the cover to lock it. The advantage of this is that, in the position in which the electrical switch is switched on, for example the cover cannot be removed from the housing.

An embodiment of the inventive device can be part of an electrical switch.

FIG. 1 shows a typical housing 200 of an electrical switch. The housing 200 is provided with a removable cover 100. The cover 100 contains a cutout 230 through which the handle 300 projects after installation.

The removable cover 100 should be designed so as to be easily removable by an installer in order to make the built-in accessories disposed below the removable cover 100 accessible. To this end the removable cover 100 in accordance with FIG. 1 is provided on a first side with a hinge 210 and is screwed by screws which are passed through holes 220 on a second side. This enables the removable cover 100 to be opened by releasing the screws in the screw holes 220. Instead of hinges 210, snap-on hooks, other attachments or screwed connections can also be provided. In the event of the electrical switch being switched off for a short circuit it can occur that the hinges 210 do not withstand the pressure and are damaged or destroyed. An embodiment of the inventive device serves to increase the stability of the removable cover 100 in relation to the housing 200.

Figure 2:
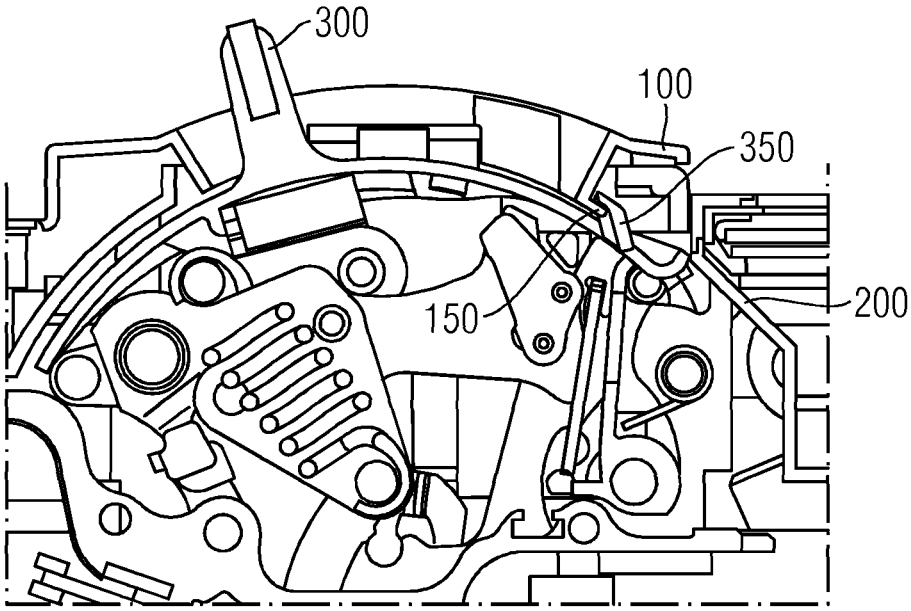
FIG. 2 shows a sectional view with removable cover and handle in a first position.

FIG. 2 shows a sectional view through the electrical switch with removable cover 100 of a housing 200. The electrical switch also comprises a handle 300, with the electrical switch being able to be switched by way of the position of the handle 300 between different states. The handle 300 is connected to the housing 200. This can be a direct connection with the housing 200, or the handle 300 can also be connected indirectly, for example via the switch block and the pole cassettes, to the housing 200.

The handle 300 comprises a contour 350, which is embodied, at least in one position of the handle 300, to interact with the removable cover 104 locking the cover 100. This locking position is shown in FIG. 2.

Figure 3:
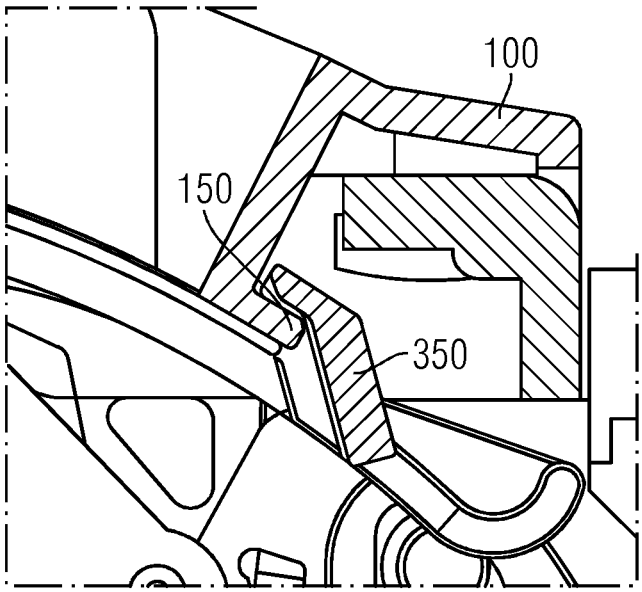
FIG. 3 shows a detailed view of the contour of the handle and a projection of the cover.

FIG. 3 shows a detailed view of the contour 350 the handle 300. In a position in which the contour 350 interacts with the cover 104 locking the cover 100, the removable cover 100 cannot be removed from the housing 200. The cover 100 can be embodied so that it includes a projection 150 which can interact with the contour 350 for locking the cover 100.

The contour 350 of the handle 300 can interact with the cover 100 when the electrical switches switched on by the position of the handle 300. This prevents the removable cover 100 being accidentally opened when the switch is switched on. The locking of the cover 100 by way of the contour 350 of the handle 300 relieves the strain on the hinges 210 in the event of a short circuit switch-off.

Figure 4:
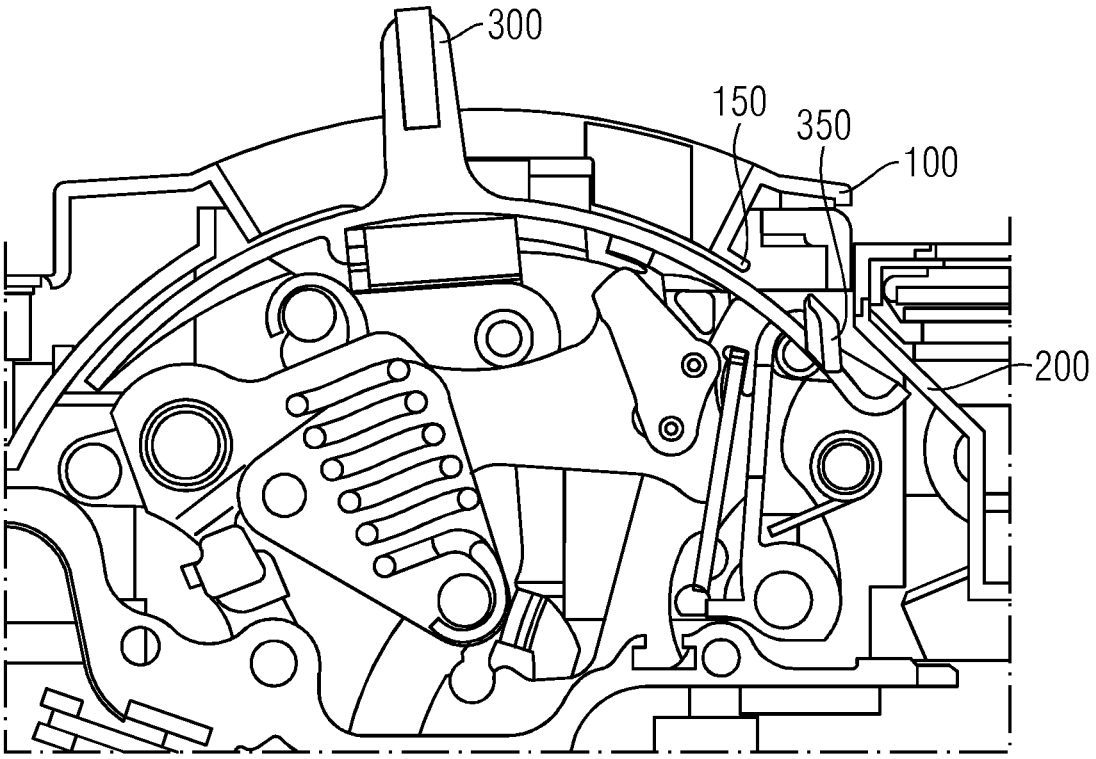
FIG. 4 shows a sectional view with removable cover and handle, with the handle being in a second position.

FIG. 4 shows a sectional view through the electrical switch with housing 200, removable cover 100 and the handle 300, whereby the handle 300 is switched in a second state. This state can for example be the state in which the electrical switch is switched off. The contour 350 of the handle 300 and the projection 150 of the cover 100 now no longer interact with each other because they are spatially separated from one another. Through the handle, which typically passes through a circular movement during switching, the contour 350 has been taken away from the projection 150. In this position it is possible to remove the removable cover 100 from the housing 200. In the position of the switched-off electrical switch it is not necessary to stabilize the hinges 210 from high pressures during short circuit switch-off.

The contour 350 can be located on an outer part of the handle 300. Since the handle 300 typically passes through a circular movement during switching, the cover of the handle 300 is often likewise embodied in the shape of a circle. Contour 350 can then be disposed at the end of the circular-shape cover which is adjacent to the hinges 210.

The inventive device in accordance with FIGS. 2, 3 and 4 can be embodied so that in precisely one position of the handle 300 the contour 350 interacts with the cover 100 to lock the cover 100.

An embodiment of the inventive device represents an additional attachment which is necessary for reasons of stability in the event of a short-circuit switch-off. The hooking of the contour 350 of the handle 300 onto the projection 350 of the cover 100 means that the removable cover 100 is additionally held. The pressure arising during a short-circuit switch-off is established before the handle is moved by the switch release so that the inventive device withstands the pressure stress caused by the short circuit switch-off. In other positions or settings of the handle, for example in the "Off position" or "Trip position", the removable cover 100 can be installed and also removed.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims.

Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A device comprising:

a removable cover of a housing of an electrical switch; and a handle including a protrusion portion extending from a curved portion, the handle, by way of a force applied to the protrusion portion, being able to switch the electrical switch between different states, the handle being operatively connected to the housing and including a contour extending from a curved surface of the curved portion, the contour being configured, at least in one position of the protrusion portion, to interact with the removable cover to lock the removable cover.

2. The device of claim 1, wherein the removable cover is an accessory cover to cover built-in accessories in the housing of the electrical switch.

3. The device of claim 1, wherein the contour of the handle is embodied in a hook shape.

4. The device of claim 1, wherein the contour of the handle is embodied to interact with a projection of the removable cover.

5. The device of claim 1, wherein at least the states of switching on and switching off the electrical switch are encompassed by the position of the protrusion portion.

6. The device of claim 1, wherein the contour of the handle interacts with the removable cover when the electrical switch is switched on by the position of the protrusion portion.

7. The device of claim 1, wherein the contour of the handle is embodied to interact with the removable cover for locking the removable cover in precisely one position of the protrusion portion.

8. An electrical switch comprising the device of claim 1.

9. The device of claim 2, wherein the contour of the handle is embodied in a hook shape.

10. The device of claim 2, wherein the contour of the handle is embodied to interact with a projection of the removable cover.

11. The device of claim 3, wherein the contour of the handle is embodied to interact with a projection of the removable cover.

12. An electrical switch comprising the device of claim 2.

13. An electrical switch comprising the device of claim 3.

14. The device of claim 1, wherein the contour is located at one end of the curved portion.

15. The device of claim 1, wherein the removable cover is curved so as to accommodate the curved portion.

* * * * *